US010492601B2

(12) United States Patent
Mirth et al.

(10) Patent No.: US 10,492,601 B2
(45) Date of Patent: Dec. 3, 2019

(54) TABLE WITH ELONGATED GROOVE HAVING APERTURES

(71) Applicants: Sarah Elizabeth-Carpenter Mirth, St. Louis, MO (US); Daniel Joseph Mirth, St. Louis, MO (US)

(72) Inventors: Sarah Elizabeth-Carpenter Mirth, St. Louis, MO (US); Daniel Joseph Mirth, St. Louis, MO (US)

( * ) Notice: Subject to any disclaimer, the term of this patent is extended or adjusted under 35 U.S.C. 154(b) by 0 days.

(21) Appl. No.: 15/687,198

(22) Filed: Aug. 25, 2017

(65) Prior Publication Data

US 2018/0055216 A1 Mar. 1, 2018

Related U.S. Application Data

(60) Provisional application No. 62/382,058, filed on Aug. 31, 2016.

(51) Int. Cl.

| | |
|---|---|
| ***A47B 21/04*** | (2006.01) |
| ***A47B 23/06*** | (2006.01) |
| ***A47B 21/06*** | (2006.01) |

(52) U.S. Cl.

CPC ..... *A47B 21/04* (2013.01); *A47B 21/06* (2013.01); *A47B 23/06* (2013.01)

(58) Field of Classification Search

CPC ..... A47B 21/04; A47B 21/06; A47B 23/06; A47B 13/16; A47B 2200/0082; A47B 2200/0077

See application file for complete search history.

(56) References Cited

U.S. PATENT DOCUMENTS

| | | | | |
|---|---|---|---|---|
| 3,635,174 A | | 1/1972 | Ball et al. | |
| 4,296,981 A | * | 10/1981 | Hildebrandt | A47B 21/06 312/194 |
| 4,948,205 A | | 8/1990 | Kelley | |
| 5,121,698 A | | 6/1992 | Kelley | |
| 5,931,103 A | * | 8/1999 | Huang | A47B 21/00 108/50.02 |

(Continued)

OTHER PUBLICATIONS

SlatePro TechDesk [online], iSkelter. Retrieved from the Internet on Jul. 18, 2017 <URL:http://iskelter.com/product/slatepro-tech-desk/>.

(Continued)

*Primary Examiner* — Hanh V Tran

(74) *Attorney, Agent, or Firm* — Creativenture Law, LLC; Dennis J M Donahue, III; Kevin C. Staed

(57) ABSTRACT

A work table for securely holding accessories that has a groove spanning a portion of the tabletop, wherein any number of tech products and other accessories can be supported. The groove runs between the side ends of the tabletop and provides a variation of mounting locations preferably on opposite sides of the lateral axis, thus having no presupposed configuration for where tech products or accessories should be supported within the groove. There is a series of apertures within the groove that allow for easy cable pass through at any point therein. Additionally, the table has a cable grid below the tabletop that allow a user to removably attach tech product chargers, power strips, or other accessories directly below the work top for easy accessibility through the series of apertures.

20 Claims, 16 Drawing Sheets

(56) References Cited

U.S. PATENT DOCUMENTS

| | | | | |
|---|---|---|---|---|
| 6,076,474 | A * | 6/2000 | Grabowski | A47B 21/06 108/50.02 |
| 6,327,983 | B1 * | 12/2001 | Cronk | A47B 21/06 108/50.02 |
| 7,278,360 | B2 * | 10/2007 | Griepentrog | A47B 21/06 108/50.02 |
| D604,958 | S | 12/2009 | Symons | |
| 8,087,738 | B2 | 1/2012 | Henriott et al. | |
| 9,210,999 | B2 | 12/2015 | Martin et al. | |
| 9,516,945 | B2 * | 12/2016 | Johnson | A47B 83/001 |
| 9,743,758 | B2 * | 8/2017 | Johnson | A47B 83/001 |
| 9,854,903 | B1 * | 1/2018 | Brandenberg | A47B 21/06 |
| 10,028,576 | B1 * | 7/2018 | Yao | A47B 21/02 |
| 2003/0070595 | A1 | 4/2003 | Crinion | |
| 2004/0149177 | A1 * | 8/2004 | Gayhart | A47B 21/06 108/50.02 |
| 2006/0096506 | A1 | 5/2006 | Brauning et al. | |
| 2007/0273256 | A1 | 11/2007 | Martin et al. | |
| 2009/0165680 | A1 | 7/2009 | Bakker et al. | |
| 2011/0297052 | A1 * | 12/2011 | Martin | A47B 13/003 108/27 |
| 2015/0173505 | A1 * | 6/2015 | Mirth | A47B 13/16 211/186 |
| 2017/0042323 | A1 * | 2/2017 | Johnson | A47B 21/06 |

OTHER PUBLICATIONS

Artifox desk [online], Artifox. Retrieved from the Internet on Jul. 18, 2017 <https://web.archive.org/web/20140506011538/http://www.theartifox.com/#intro>.

* cited by examiner

SECTION A-A

DETAIL B

DETAIL A

TABLE WITH ELONGATED GROOVE HAVING APERTURES

CROSS-REFERENCE TO RELATED APPLICATIONS

This application claims priority from U.S. Provisional Patent Application No. 62/382,058 filed on Aug. 31, 2016 which is herein incorporated in its entirety.

STATEMENT REGARDING FEDERALLY SPONSORED RESEARCH

Not Applicable.

APPENDIX

Not Applicable.

BACKGROUND OF THE INVENTION

Field of the Invention

The present invention relates to a table for securely holding accessories and for working, more particularly to a desk with a tech products and wire organization system.

Related Art

Prior art tables and desks typically have holes within a tabletop through which cables can be passed and plugged into power sources or other ports below the table or desk. These currently known tabletops generally disclose one or more holes located at particular positions on the desk's top surface that can be covered when they are not being used. Typically, these holes are arranged towards the back corners of desks or towards the center of large conference tables to avoid interrupting the main working surface of the tabletop. These known desks and wire control systems limit where the wires can be routed because of the limited number of holes on the work surface. Further, most of these holes do not act as a support or anchoring structure for tech accessories like phones and tablets and instead only provide limited routing means for the tech accessories' wires. Additionally, the covers for most of these holes project above the top surface of the tabletop and can actually interfere with the use of the tabletop and may reduce the flat working surface of the tabletop.

When in use, wires pass through the holes and are generally run into a cable collection area or are further routed in "wire channels" to a power source or other electronic port. In many cases, wire channels route wires down the legs of the desk or table. Some desks do not route cables to external power sources or similar electronic ports but instead provide a "technology trough" below the tabletop's working surface to provide readily accessible power without the need for long and/or exposed wiring. However, the desks that provide more direct access to power sources or other electronic ports typically suggest a permanent attachment of the electronic port within the technology trough. Since the ports are permanently attached, a user cannot quickly attach their power source or charger to these technology troughs and then remove it sometime later. Additionally, the technology troughs are typically designed for electronic ports and power sources of a specific type. Therefore, a user is again limited in how they may use these desk systems as they are not universally designed to accept any type of power source or charger in the technology trough.

Another aspect of many prior art desks is the inability for a user to customize where multiple accessories are placed on their work top based on their particular needs. For example, in prior art desks, such as with the iSkelter SlatePro Tech Desk and the original Artifox desk, the wire holes and corresponding grooves are prearranged for particular size electronic devices and desk accessories, and the accessory organization ledges correspond to the locations of the wire holes. These prior art designs presuppose where a user wants their accessories placed on their work station and fail to provide a user with the ability to customize their work station to best fit their individual needs as the position of devices is limited to the location of the wire holes and corresponding organization ledges. Therefore, it is another object of the present invention to provide an accessory and wire organization system that allows a user to position accessories about their work station as they see fit as well as hold multiple devices. In addition, the present invention enables easy wire pass through regardless of the user's preferred accessory arrangement.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1B:
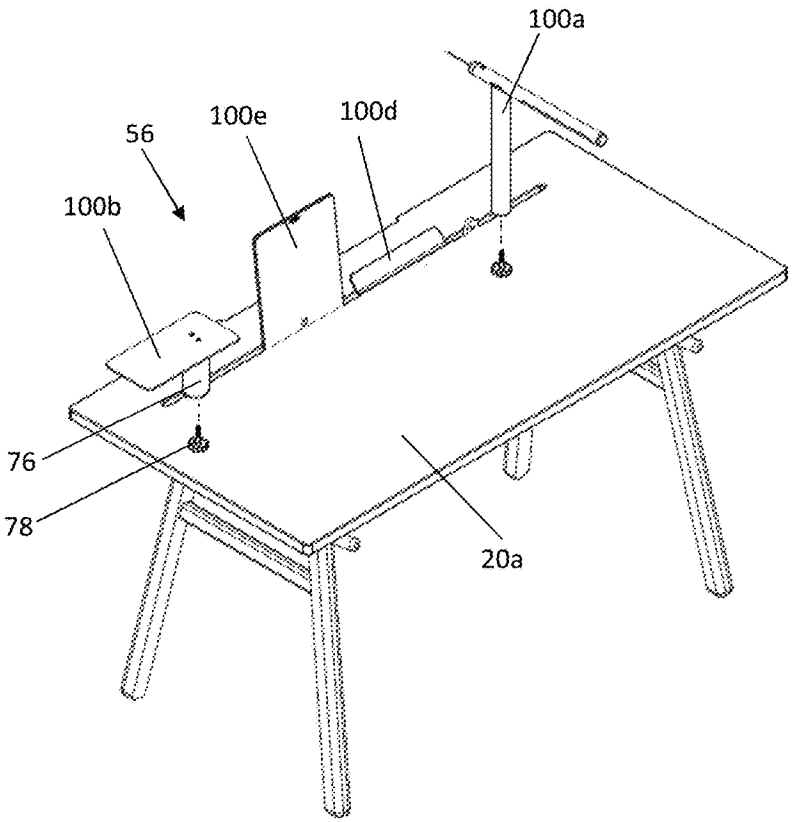
FIGS. 1A-1E are perspective views of the table according to an embodiment of the present invention with different arrangements of electronic equipment and accessories.
Figure 1A:
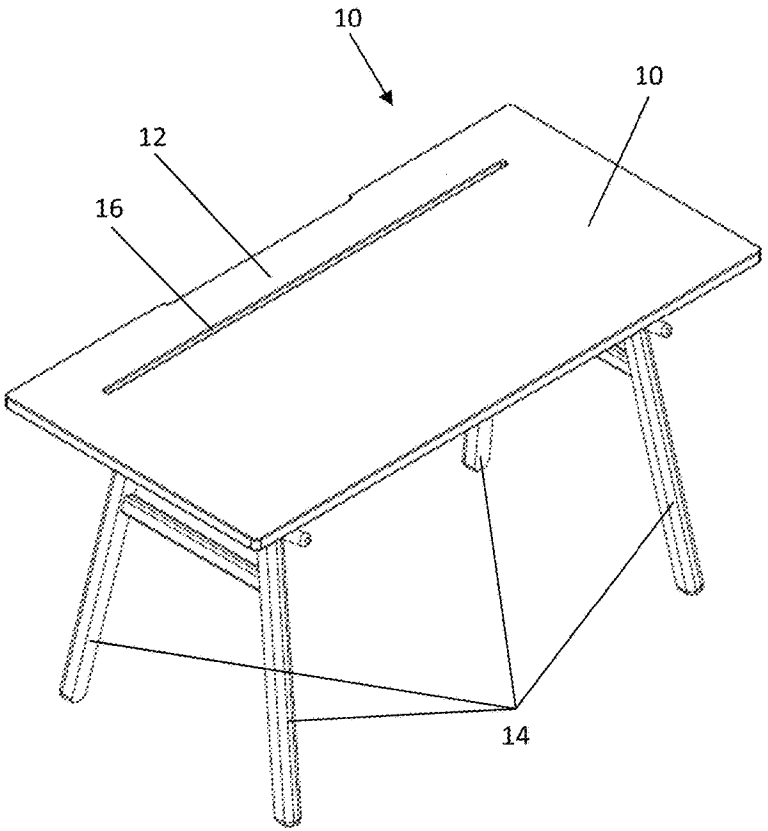
Figure 1D:
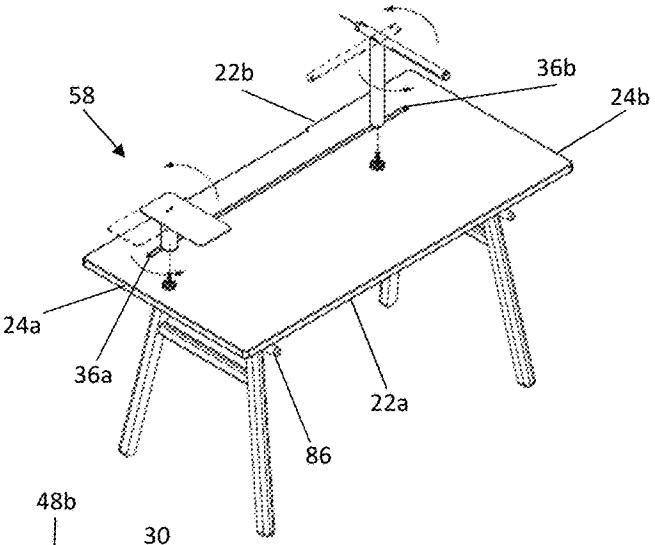

The following description of the preferred embodiment(s) is merely exemplary in nature and is in no way intended to limit the invention, its application, or uses.

A work table for securely holding accessories that has a groove spanning a portion of the tabletop's width. The groove has a series of apertures that allow any number of tech products and other accessories to be supported or anchored. The groove extends between the side ends of the tabletop and is preferably disposed on both sides of a lateral axis in the tabletop's center. The spacing of the apertures throughout the groove provide for a variation of mounting locations through which a cable can pass through or to which a mounting bracket can be secured that allows the groove in the desk to hold multiple accessories and electronic devices at different locations and arrangements, thus having no presupposed configuration for where the electronic devices or accessories should be supported or anchored within the groove. The series of apertures preferably extend through the bottom trough of the groove to the bottom side of the tabletop which allows for easy cable pass through at any point within the groove. Additionally, the table preferably has a cable grid that is attached between the table legs that allows the chargers, power strips, cabling, or other accessory equipment to be secured to the desk directly below the tabletop. The cable grid may serve as a rigid structural support between the table legs but does not need to provide structural support and may even be flexible.

As indicated in more detail below, the table may have a plurality of grooves and/or cable grids and the grooves may be found at any point between the front and back of the work top. One embodiment may be a smaller single person desk with a single groove located towards the rear of the work top. In such an embodiment a single cable grid may be attached below the rear legs. However, another embodiment may have one or more grooves towards the center of the work top and be designed for multiple users or to be used as a conference table. Such an embodiment may also have more than one cable grid to allow for more tech product charges and other accessories to be suspended below the work top. As also explained below, it is possible that in addition to the groove and apertures, the table may have a notched section along one or more edges to allow for additional cable pass through space when the table is pushed up against a wall, table or other obstruction. The notch is particularly beneficial for cables which have a head that is larger than the apertures in the groove, such as power cords and some audio/video cords.

The table 10 has a tabletop 12, legs 14, a groove 16, and a series of apertures 18 within the groove that is used to pass cables below the table as well as for mounting accessories 100 as generally described above and more particularly described below. The tabletop itself has a top surface 20*a* and bottom surface 20*b* with a front end 22*a*, back end 22*b*, and a pair of side ends 24*a* and 24*b* which define the width 28 and depth 30 of the tabletop. The tabletop also has a central lateral axis 32 located equidistant between the pair of sides and in some embodiments the groove is reflected about this lateral axis. The groove is recessed from the top surface of the tabletop by the recessed depth 44 of the grooves, which is less than the thickness 26 of the table. Accordingly, the groove has a pair of ends 36*a* and 36*b* and a pair of sidewalls 40*a* and 40*b* equal in length to the recessed depth of the groove. The groove also has bottom trough 38 positioned below the tabletop to surface between the sidewalls and spanning between the first and second end of the groove. Extending from the bottom trough of the groove to the bottom surface of the tabletop are the series of apertures through which wires and mounting devices may pass. In order to hold multiple devices within the groove, a first set of apertures 18*a* is proximate to the first end and a second set of apertures 18*b* is spaced a distance from the first set towards the second end. Accordingly, in other embodiments there are additional apertures within the groove between the first set and second set as shown in FIGS. 1 and 2. Additionally, the apertures have a length 50 that is equal to the first distance between the apertures in the preferred embodiment.

Figure 1E:
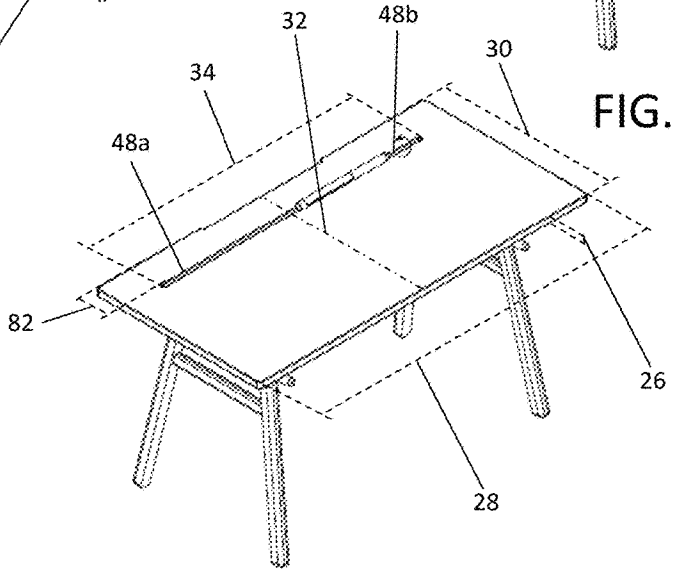
Figure 1C:
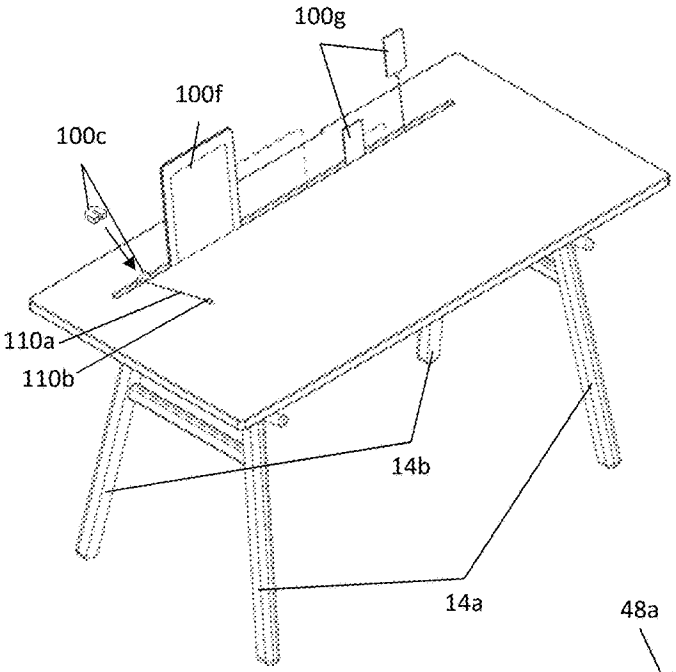
Figure 1F:
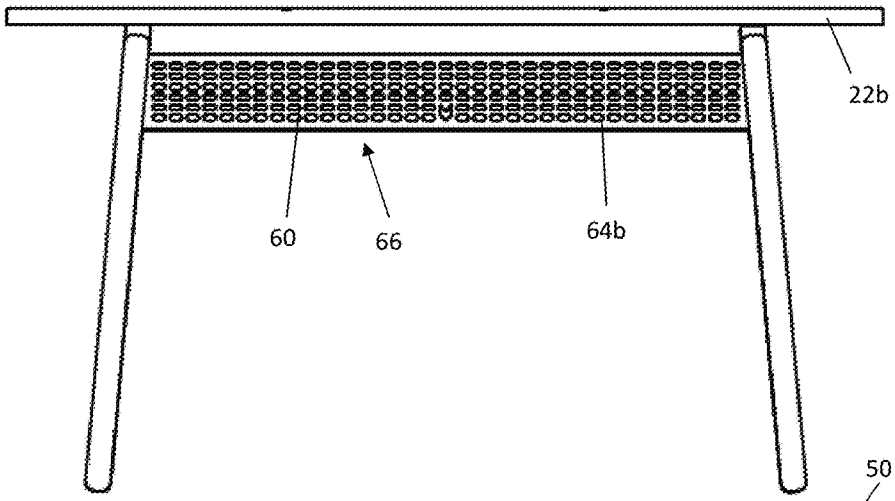
FIG. 1F is a front view of the table shown in FIG. 1A.
Figure 1G:
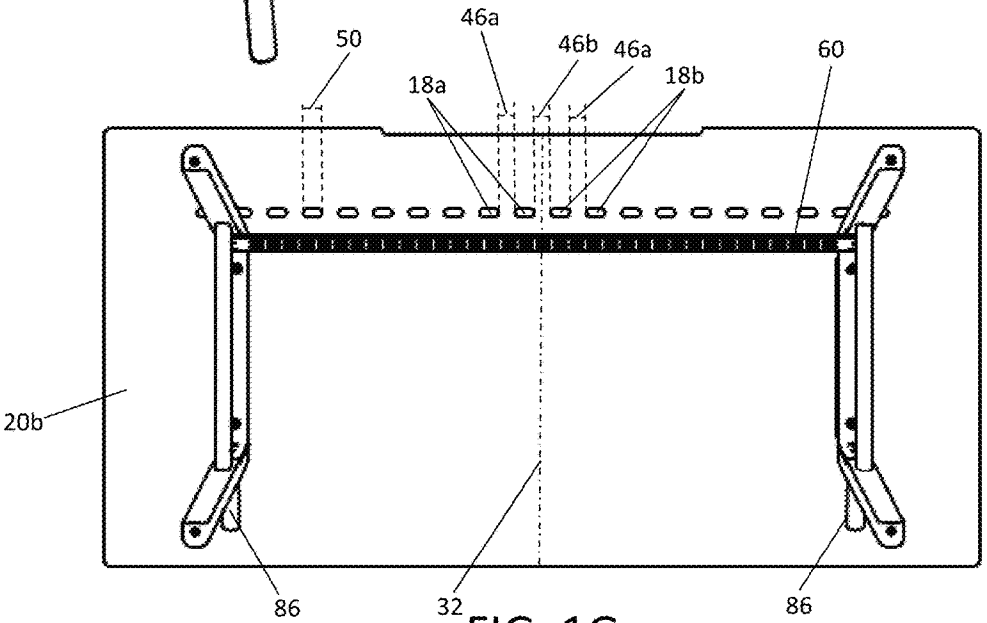
FIG. 1G is a bottom view of the table shown in FIG. 1A.
Figure 2A:
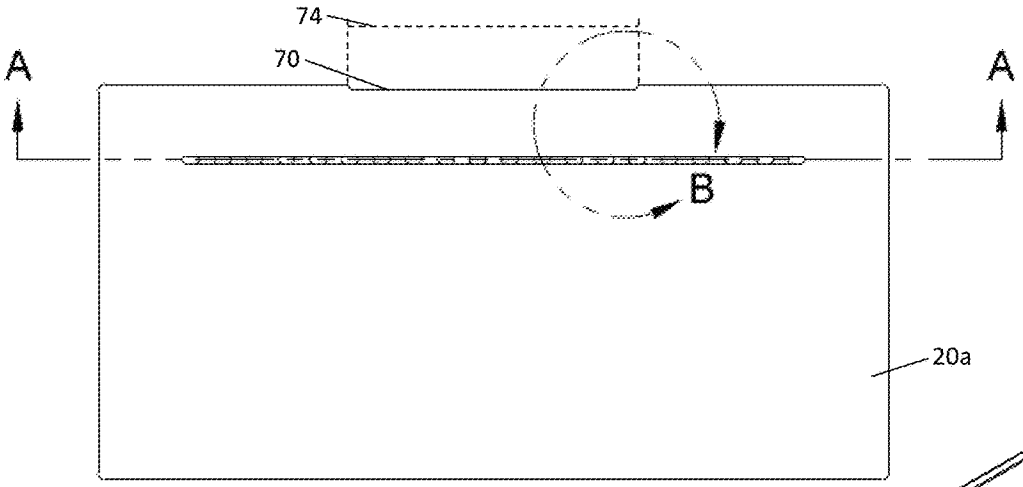
FIGS. 2A-2G are detail views of the groove and apertures in accordance with an embodiment of the invention.
Figure 2D:
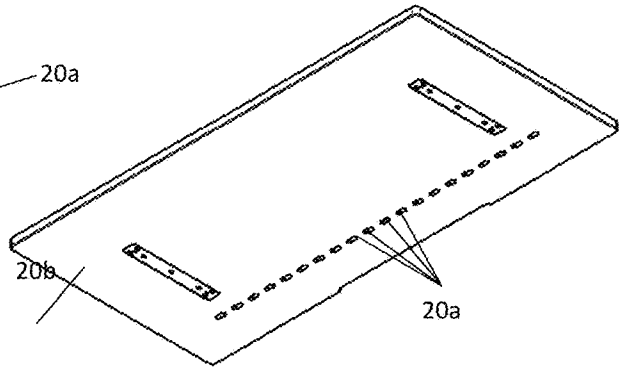
Figure 2C:
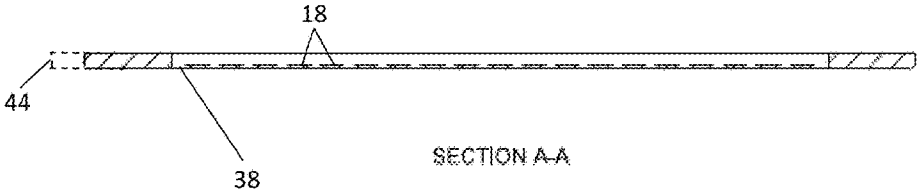
Figure 2B:
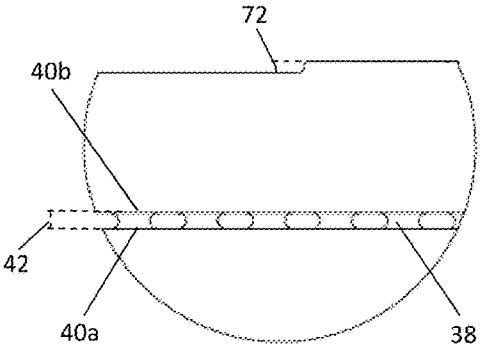
Figure 2F:
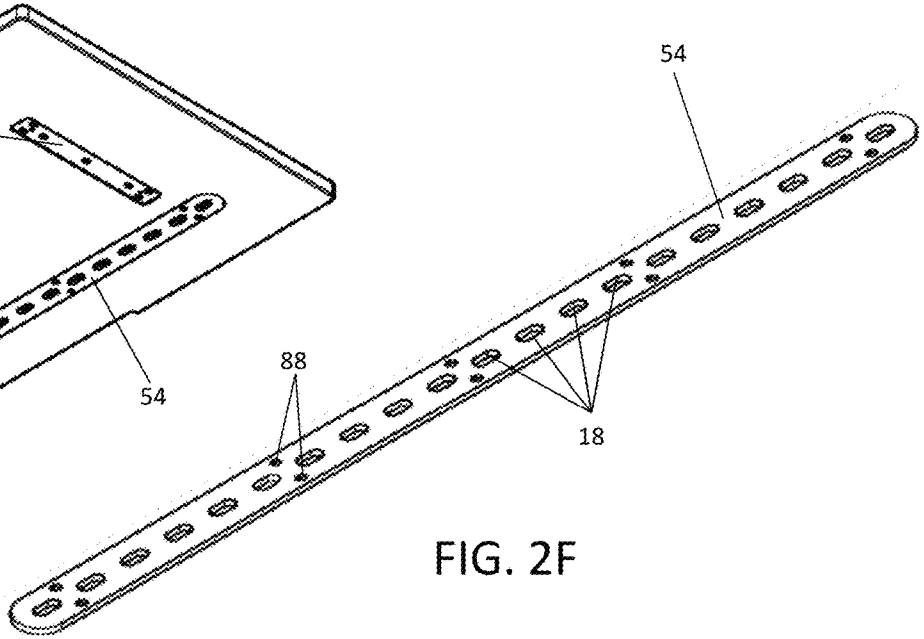
Figure 2E:
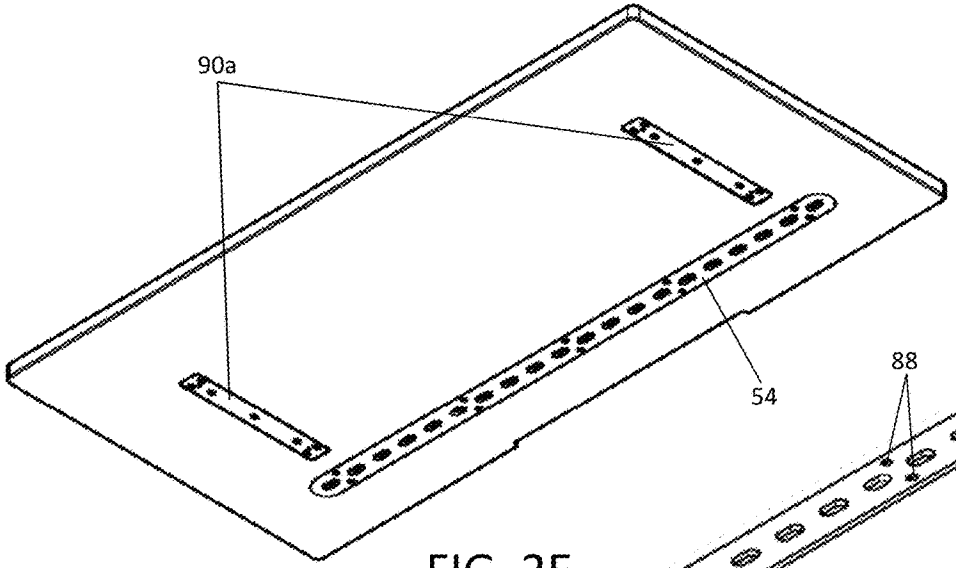
Figure 2G:
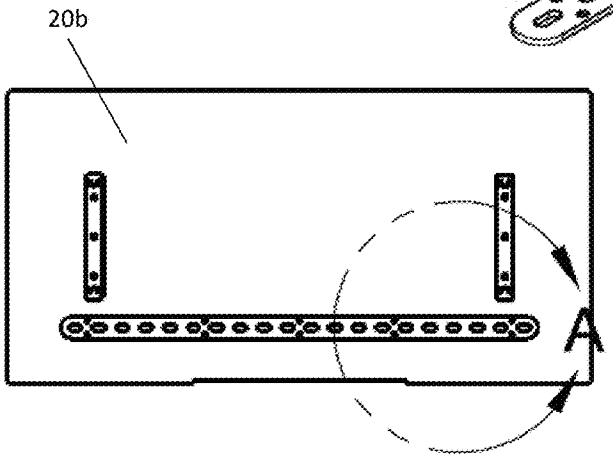
Figure 2G:
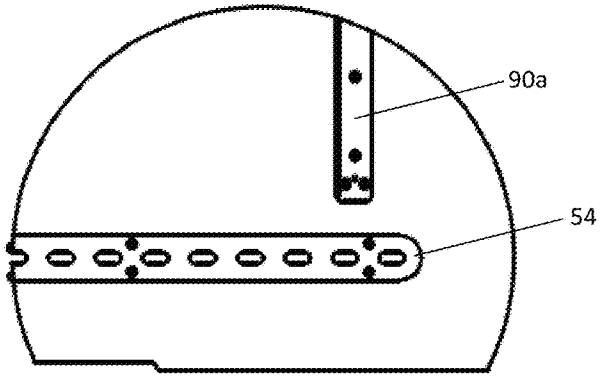
Figure 2H:
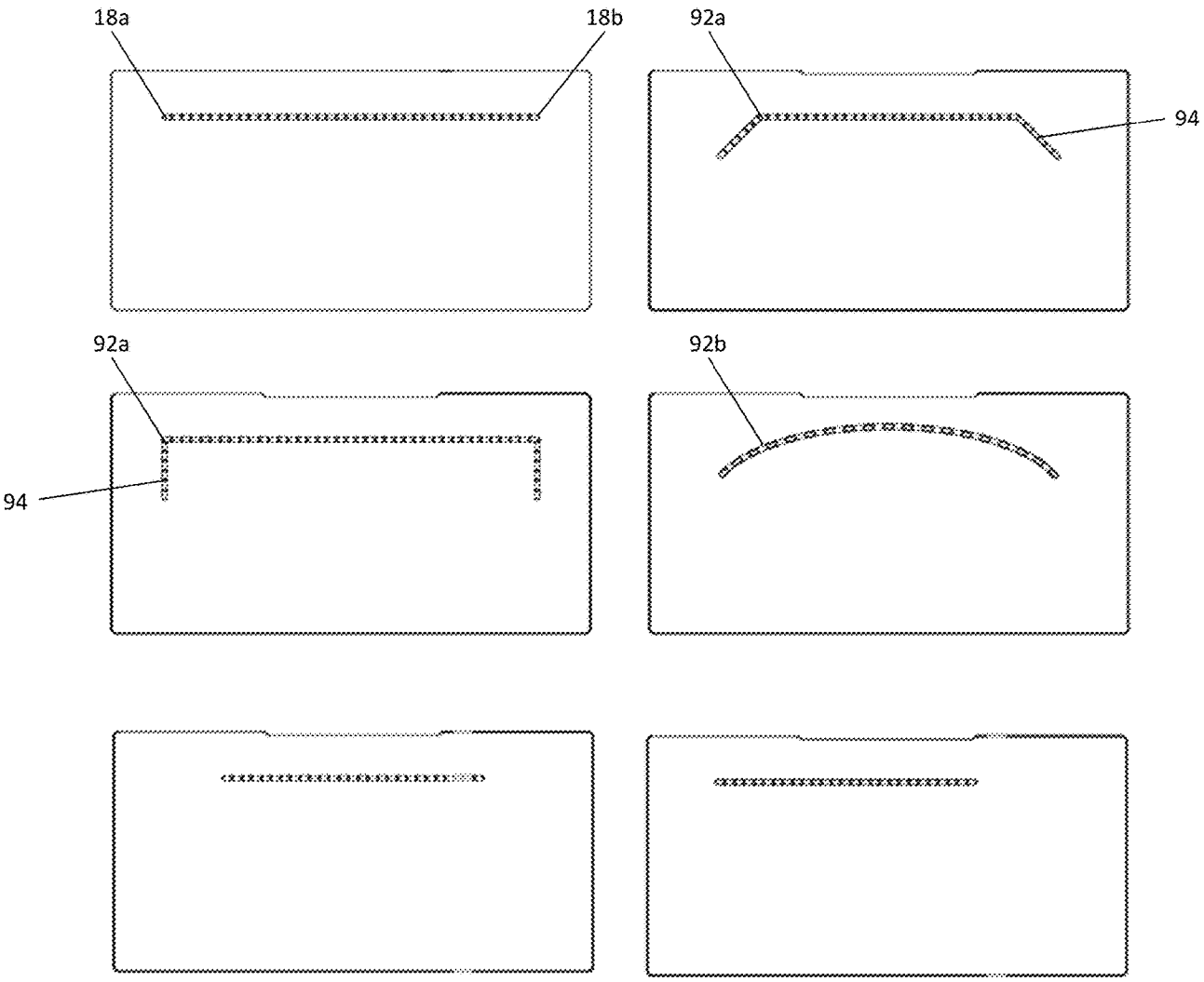
FIGS. 2H and 2I are top views of the table of the present invention with alternative groove shapes.

As illustrated in FIG. 1, an aspect of the table is the groove spanning a majority of the tabletop's width between the tabletop's side ends. Although the length 34 and position of the groove may vary between embodiments, an aspect of the groove or multiple grooves is to provide multiple mounting positions 56 relative to the lateral axis of the table. For example, as shown in FIGS. 1 and 2H a single groove may span across the lateral axis of the table and provide multiple mounting positions within a single groove. However, as shown in FIG. 21 multiple grooves that do not span across the lateral axis of the table may also provide multiple mounting positions within a first groove 16*a* proximate to one side of the table and a second groove 16*b* proximate to the opposite side of the table. Generally, the total length of the groove or grooves is greater than the depth of the tabletop which provides a wide range of mounting options and positions for electronic equipment and other accessories.

Figures 4A, 4B, 4C:
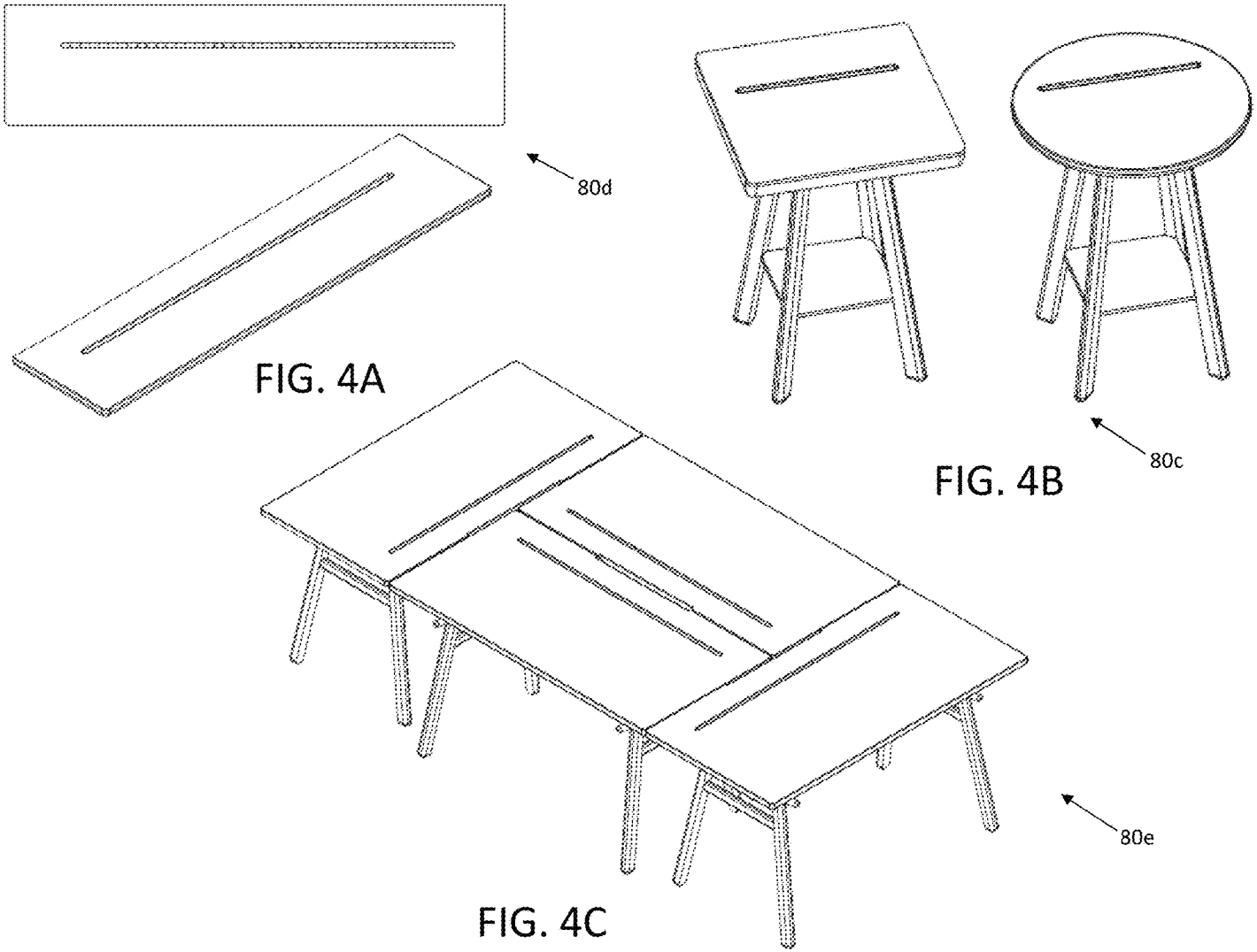
FIGS. 4A-4F are perspective views of variations of tabletops in accordance with embodiments of the present invention.
Figure 4F:
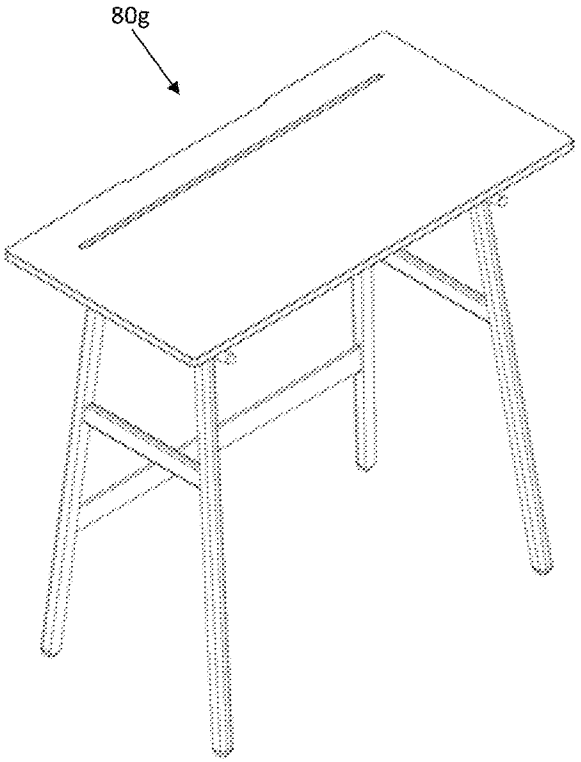
Figure 4D:
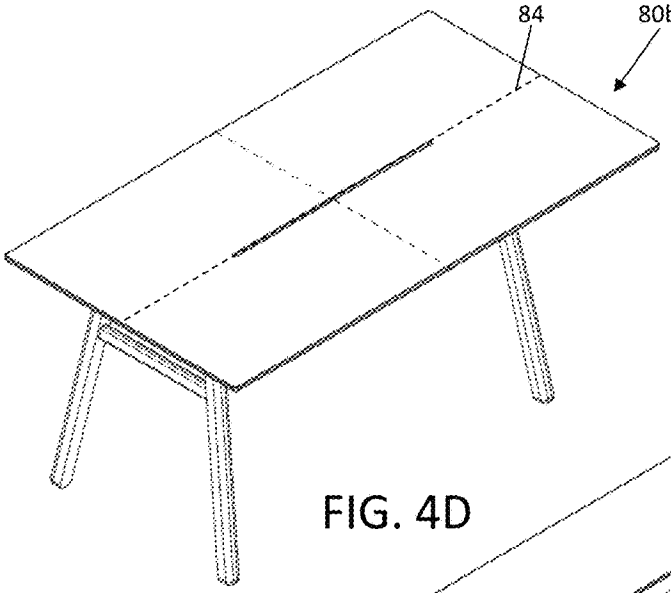

As the groove and apertures within are preferably formed on both sides of the lateral axis, a user may support or anchor any accessory within the groove on both sides of the work top. Such an aspect allows the same work top to be used by a left-handed user and a right-handed user while providing both users the ability to customize their accessory arrangements within the groove. Similarly, a user may mount multiple accessories within the groove in a variety of locations as the groove is not limited to holding a single device as seen in the prior art. For many desktops, the groove will be parallel to and offset from the longitudinal axis of the desk by a distance 82 toward the back of the desk to provide a larger workspace toward the front end of the desk. For conference room tables, the groove may be aligned with the longitudinal axis 84 as shown in FIG. 4D.

Further, as most tech products require a power source or charging station, the groove is outfitted with a series of apertures that allow a wire to be passed through for easy plug in. While other inventions use holes to route wires out of sight to power sources, the present invention's series of apertures within its groove directly route wires out of sight. Other inventions only have a limited number of holes on a work top and multiple wires are simultaneously routed therein after being run along the work top to the holes, which are generally seen near tabletop corners. Conversely, the present invention provides a series of apertures for each and every tech product wire that may be supported or anchored within the groove. This series of apertures provide a routing hole for every tech product wire as well eliminating the need to route wires on the work top at all. Instead, a tech product may be supported by or anchored in the groove directly above a routing hole wherein the wire is never seen on the work top. Thus, the present invention provides more routing holes, thereby eliminating the need to use a single hole for multiple wires and further provides a more streamlined work space as no wires are routed across the work top.

The series of apertures spans the length of the groove and multiple sets of apertures may be found on both sides of the tabletop's lateral axis. In all embodiments one set of apertures has a first spacing 46*a* and a second set of apertures is spaced apart from the first set by another distance 46*b*. In one embodiment, the sets of apertures are equidistant apart. In another embodiment the sets of apertures are separated by a distance greater than the first spacing. And in another embodiment each set of apertures are proximate to opposite side edges of the groove 36*a* and 36*b* and are therefore on opposite sides 48*a* and 48*b* of the lateral axis. Additionally, where there are multiple grooves a third 18*c* and fourth 18*d* set of apertures are spaced on opposite sides of the second grooved for example the first groove spans between a first and second end and the second groove spans between a third 36*c* and fourth end 36*d*. Regardless of the embodiment, it is an aspect of the present invention to provide a series of apertures wherein multiple holes are available for more than one tech product or accessory as described below.

In one embodiment the groove and series of apertures are integrally part of the tabletop. As shown in FIG. 2A-2D, the series of apertures are cut directly out of the base of the groove. In this embodiment, the groove depth is less than the thickness of the tabletop and the series of apertures provide pass through from the base trough of the groove to the below the tabletop. This integral design eliminates the need for assembly where the tabletop is already outfitted with an operable groove and series of apertures when it arrives to the user. Therefore, a user need only attached the table legs and cable grid 60 before use. One or more of the front legs may have a hook 86 extending outwardly.

In another embodiment, the groove may be comprised of a series of apertures that is separate from the tabletop. As shown in FIGS. 2E-2G, this embodiment has the a groove and slot 52, but instead of a base trough with the series of apertures cut therefrom, a separate insert or other slot bracket 54 is affixed to the tabletop, preferably to the bottom of the tabletop or within the slot. As shown in the detail view of FIG. 2G the slot bracket has multiple holes 88 to allow a fastener, like a screw, to be used in mounting the bracket to the bottom side of the tabletop. However, this bracket may be attached to the tabletop by any number of means including adhesive, nails, pins, or any other fastening means capable of affixing the bracket within or proximate to the groove in the tabletop. Similarly, tabletop mounting brackets 90*a* may also be attached to the bottom side of the tabletop as shown in FIGS. 2E and 2G, which attach to the upper brackets 90*b* connected between the pair of legs. The slot bracket includes the apertures for the cabling and serves as the bottom trough of the groove and may be pre-attached to the tabletop which similarly provides a "limited assembly needed" table to the user, but it may also be included separate from the tabletop. This embodiment may also provide a magnetic attraction for accessories like cable stops 100*c* or pencil trays 100*d* that are not fully anchored within the groove by a mounting bracket 76 and fastener 78, as described below. Although a magnetic attraction may be available in the integral embodiment, it is also aspect of this non-integral variation.

Figure 2I:
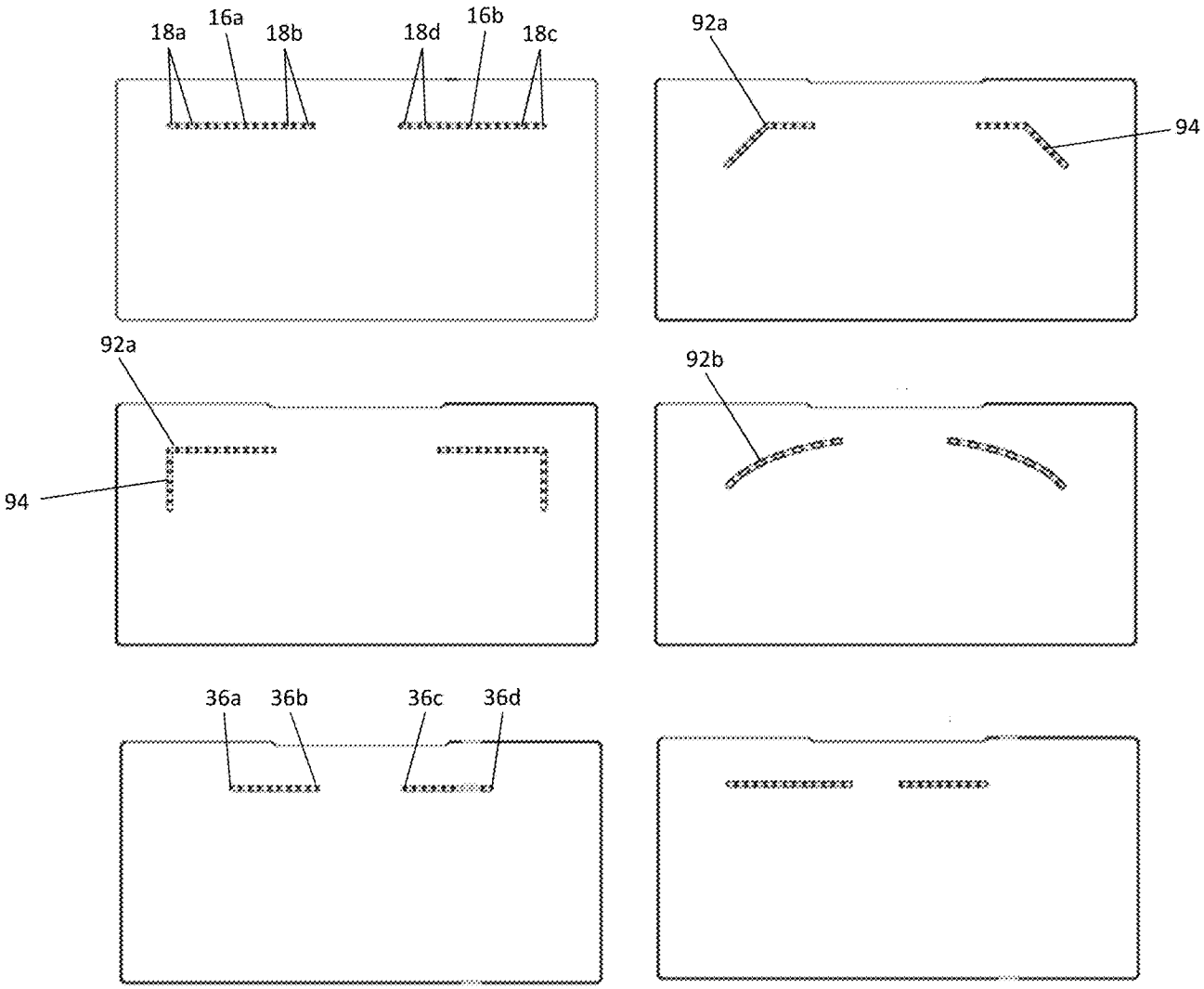

As illustrated in FIGS. 2H and 2I, the configuration and shape of the groove can be varied, and the notch 70 at the back of the desk is optional. The groove may be angular 92*a* or have a U-shape 92*b* or be in the shape of an arc. In each of these optional shapes, a section of the groove remains towards the back of the tabletop, and side sections 94 of the groove extend toward the front of the desk. The size of the groove can be varied relative to the tabletop size, and the groove can be positioned off-center from the desk's lateral axis. It will also be appreciated that the groove does not necessarily need to be parallel to the longitudinal axis of the desk.

In addition to providing support for tech products, another particular aspect of the groove is its ability to hold other non tech accessories. As illustrated in FIGS. 1B and 1C, the groove itself is designed to support any number of accessories that a user may need at his or her work station. The series of apertures allow wires 110*a* to pass through the desktop for tech products like phones 100*g*, computers, and tablets 100*f*. When the wired tech product is held within the groove and connected to the wire, the wire head 110*b* can fit within one of the apertures in the base of the groove. To prevent the wire from falling through the aperture when the tech product is disconnected from the wire, a fastener, such as an anchor or a knot 100*c*, can be connected to the wire.

It is another aspect of the apertures to also secure non-tech accessories, such as writable and erasable slates 100*e*, pen and pencil holders, laptop stands, monitor mounts, shelves 100*b*, lights 100*a*, and other tools and tool holders. These accessories may include a light or a shelf, as shown in FIG. 1B, among others. To hold an accessory in the groove, the accessory's mounting bracket extends through the aperture to the bottom side of the tabletop where it is secured with a fastener 78. In other embodiments the accessory may be secured through the aperture by other means including magnets, a friction-fit connection, interlocking or plastic attachments, hooks, a thumb screw, spring loaded latch, compression gasket, or other similar securing means. Despite which embodiment is used to anchor the accessory, a user particularly designs their work space to meet their needs and thereby increases productivity.

Other embodiments may similarly promote secured accessories without any type of anchoring. As seen in FIGS. 1B and 1C, a pencil trough and dry erase board may be supported within the groove in the same way tablets, phones, and other tech products are supported. Therefore it should be appreciated that in one aspect the groove is designed to provide support and streamlined wire organization for tech products, but in another aspect it may be used to support any number of non-tech products, including books, cable stops, writing utensils, papers, folders, and other accessories not included herein.

Figure 3B:
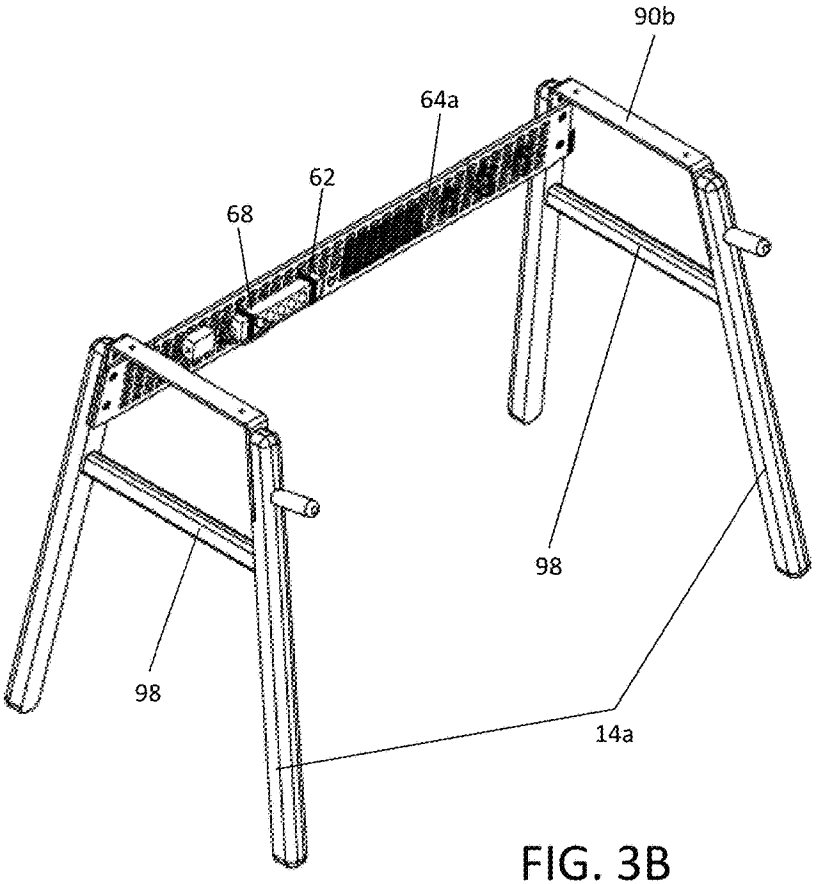
FIGS. 3A-3F are perspective views of the cable grid in accordance with embodiments of the invention.
Figure 3A:
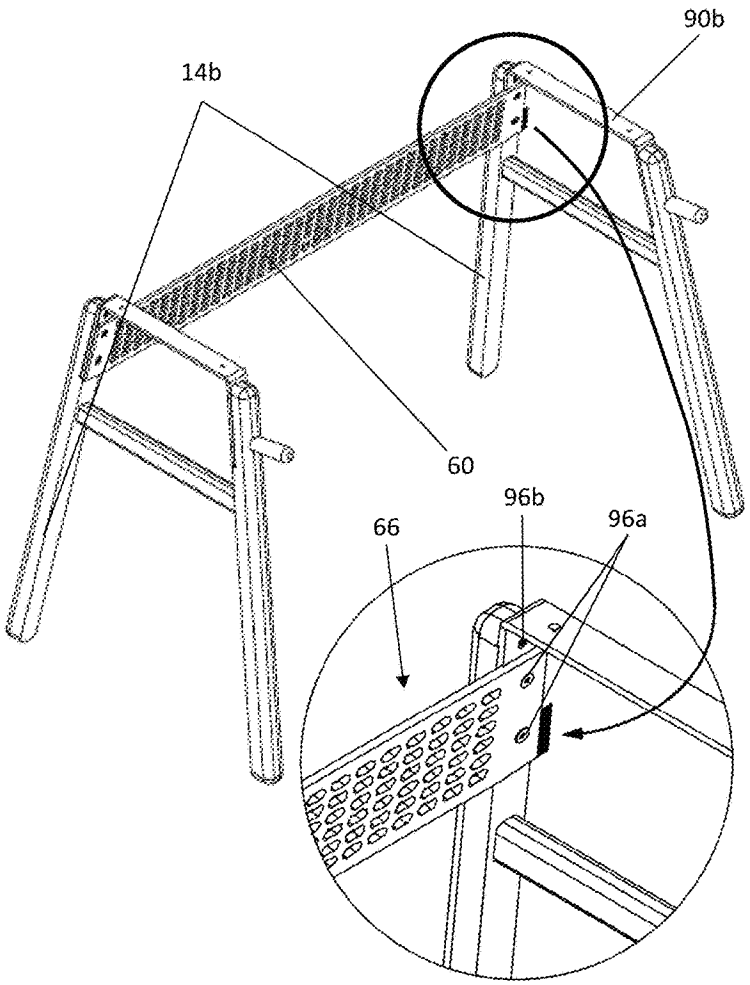

In another aspect of the present invention, a cable grid is supported between the table legs wherein chargers 120*a*, power strips 120*b*, external hard drives, or other accessories may be removably attached thereto. The cable grid has both a front 64*a* and back face 64*b* where chargers, power strips, or other accessories may be attached. As illustrated in FIG. 1F and FIGS. 3A-3D, the cable grid itself is made up of a single sheet of material having an array 66 of apertures thereon. These holes allow the accessories to be affixed thereto using a simple fastener 62 that attaches to a portion 68 of the accessory, such as shown in FIG. 3B. In some embodiments the fasteners used may include hook and loop straps (i.e., VELCRO® straps), wire, string, clamps, screws, bungee cords, magnets, tape, hooks, or similar attachment means. The cable grid may also have a tag or other label extending from one side. The tag can be similar to those used for apparel or other fashion labels which are branded and may be made from fabric, paper, or a flexible plastic material (TYVEC).

It is an aspect of the cable grid to allow a user to quickly attach or remove these accessories which further facilitates a user specific setup. Further, unlike many other inventions that described "technology troughs", the accessories attached to the cable grid are not required to specifically fit within a particular trough port. Some known technology troughs have specific apertures that hold power sources while others hold phone or internet ports. The cable grid of the present invention is not limited by specific accessories but instead allows for any accessory to be mounted thereto in any arrangement 58 the user would like. This non-exclusive design allows a user to attach any type of charger, power source, or similar device rather than solely those designed to fit within a "technology trough." Additionally, the cable grid allows the equipment and accessories to be attached to the cable grid's front surface and/or back surface.

Figure 3D:
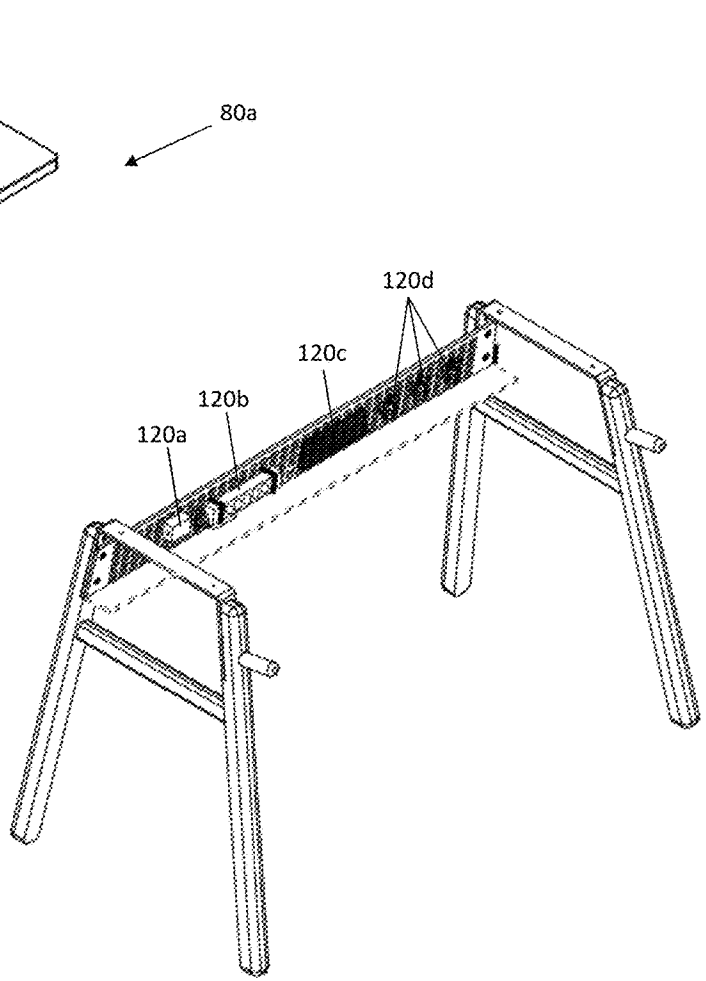
Figure 3C:
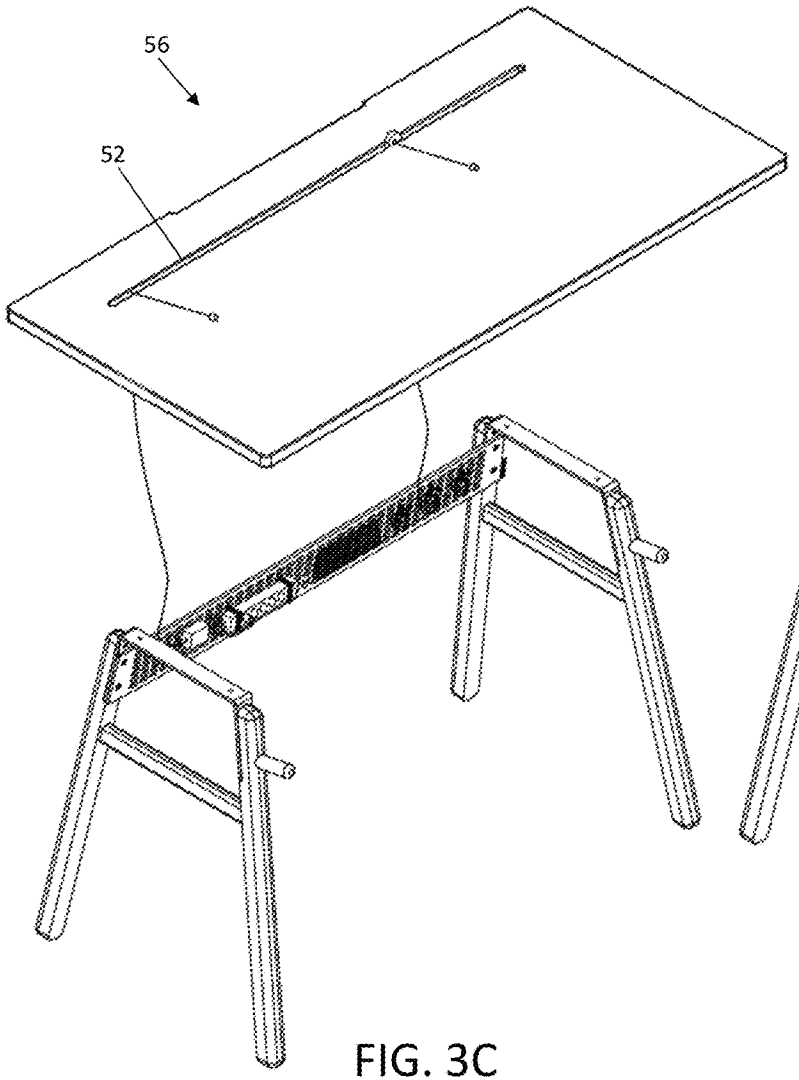

The cable grid itself is supported between the table legs proximate to the groove and attached thereto by a fastener 96*a*. As shown in the detail view of 3A, a pair of mounting holes is found on each end of the cable grid and a fastener extends through the holes and screws into corresponding leg holes. Although screws may be used in a preferred embodiment, other types of fasteners may be used including but not limited to bolts, nuts, adhesives or other similar fastening means. Additionally, a third leg hole and fastener 96*b* is oriented above the cable grid mounting holes into which an upper bracket that supports the tabletop is attached. As shown in the drawings, the upper bracket attaches the front legs 14*a* and back legs 14*b* and supports the tabletop. The bracket is attached to the legs by a pair of fasteners substantially perpendicular to the cable grid fasteners as shown in FIGS. 1G and 3C. Accordingly, each leg has multiple holes proximate to the tabletop used to support the at least one of the cable grid, upper bracket and brace described below.

In addition to being attached to the tabletop by the upper brackets, the legs also have a crossbar support 98 attaching the front legs to the back legs on both sides of the tabletop. As shown, the crossbar is affixed between a pair of legs below the tabletop and upper bracket, perpendicular to the cable grid and brace described below. In the preferred embodiment the legs are angled away from the tabletop and thus do not extend completely perpendicular between the bottom of the tabletop and the ground. In another aspect of the legs, pegs extending from the front legs may be attached proximate to the tabletop which can be used to hang items such as head phones or objects with straps or handles, such as umbrellas, handbags, backpacks or similar items.

Further, in the preferred embodiment the cable grid is parallel with the groove and is affixed between the pair of legs proximate to the groove. As seen in FIGS. 1F and 1G, in this preferred embodiment the cable grid runs below the series of apertures and provides a user an accessible readily accessible power source or charger. In another embodiment a pouch or net 120*c*, seen in FIG. 3B is suspended from the cable grid and may hold any type of object that is routed through the tabletop's apertures like excess cord length 120*d*. In addition, the net may be used to simply hold items like manuals, extra wires, travel cases, batteries or other items associated with chargers, tech products, or other accessories that are not used while the user is at the work station. Further, in addition to chargers, power strips or the holding net described herein, a user may attach any number of other accessories that may be needed below a work station including but not limited to air fresheners, cables, lights, etc. Although in the preferred in embodiment there is only a single cable grid, another embodiment may have multiple cable grids 60*a* and 60*b*, seen in FIG. 3E, that allows for even more accessories to be attached under the tabletop. As shown, the cable grid is in a vertical orientation, and it will be appreciated that the cable grid may be in a horizontal orientation or there could be grids in both vertical and horizontal orientations. It is also possible to combine a vertical cable grid with a horizontal shelf that may be attached to the cable grid, separate from the cable grid, or integrally formed as a part of an L-shaped cable grid such as shown in FIG. 3D.

Figure 3F:
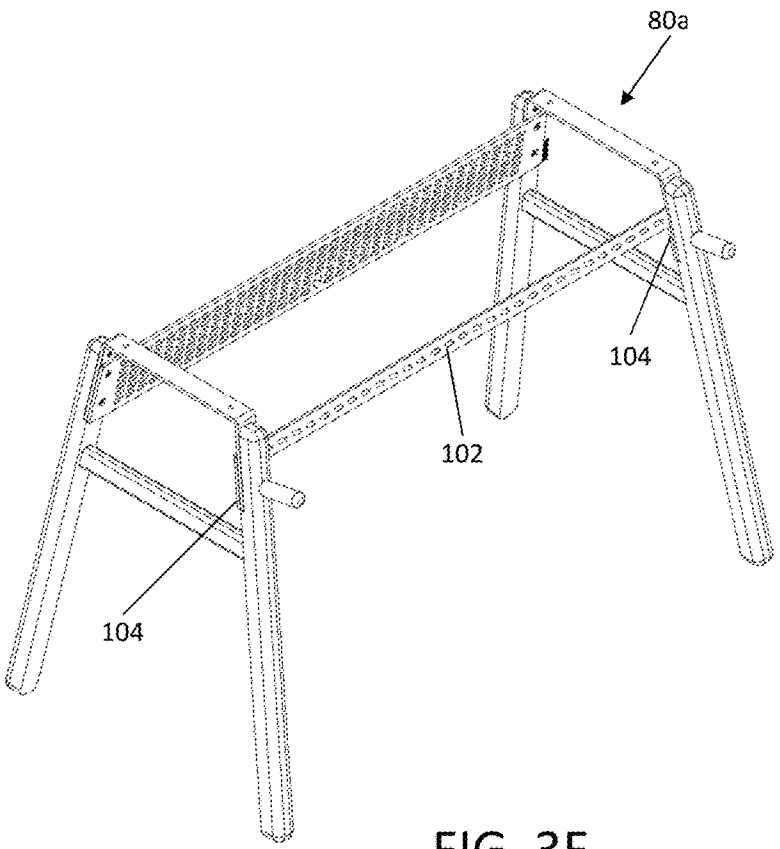
Figure 3E:
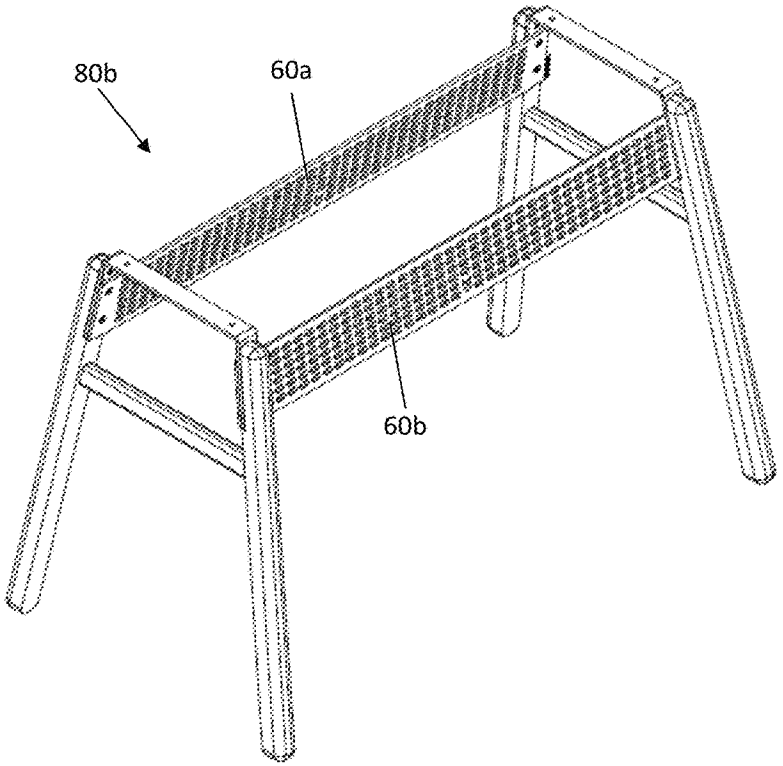

In addition to the cable grid, the desk may have a brace 102 that provides additional support and stability between the table legs, such as shown in FIG. 3F. In the preferred embodiment, the brace is narrower than the cable grid and is connected between the front pair of legs opposite from the cable grid by fasteners that attached to at least one of the leg holes discussed above. The brace can be used with the standing desk, such as shown in FIG. 4F, or may be used with a standard desk. The brace is attached to the legs by a bracket 104 which extends perpendicular to the longitudinal axis of the brace so that the bracket partially extends along the length of the legs, providing additional stability. Accordingly, this bracket design allows the brace to be placed in the same leg hole patterns that used to attach the cable grid to the legs described above. It will be appreciated that in some embodiments where a cable grid is not necessary or otherwise desired, the brace could be used at the front and the back of the desk.

Although the groove and apertures provide substantially more cable pass through avenues for tech products, another aspect of the present invention is an elongated notch 70 along one or more sides of the tabletop. Such a notch is seen in FIG. 1 and allows for another pass through for larger cables, such as power cords for computers, printers, and other electronic equipment. Although these wires may fit within the apertures, a user may also run them behind the work top's edge that is up against an obstruction like a wall or other desk, when in such an arrangement. This notch preferably has a span 74 that is commensurate in size with the length of the groove in the table, less than the width of the table, and has a cut-in distance 72 that is a commensurate in size with the width of the groove 42, and it provides even more user discretion as to how they would like to route their wiring while maintaining a streamlined and clutter free work station. The notch also allows for seamless monitor mounting when desks are pushed together or up against a wall.

In another aspect of the present invention, the table may combine any number of its other features as illustrated in FIG. 4. Although the above description relates primarily to a desk 80*a* or conference table 80*b*, the present invention may be applied to a night stand or end table 80*c* as shown in FIG. 4B. The inventive groove and series of apertures within allow a user to support a phone or tablet on a nightstand, while maintaining the easy cable pass through as described above. The groove and series of apertures can also be incorporated into a single shelf 80*d*, as shown in FIG. 4A, which can be mounted to a wall with bracket legs or multiple shelves, such as in a bookcase that has base legs (not shown). In another embodiment, a single desk variation may be combined together with other desks to create a larger work station 80*e*, work bench, or a makeshift conference table as depicted in FIG. 4C. In still another embodiment 80*f*, the table may have multiple grooves proximate to the center of the desk wherein a number of users may work on all sides. Such an embodiment can be seen in FIGS. 4D and 4E. Additionally, the length of the table legs may be any number of lengths including but not limited to a standard length for a sitting desk and longer lengths used in standing workstations 80*g* as shown in FIG. 4F. It will also be appreciated that the length of the legs can be shorter than the standard length of sitting desks, such as for coffee tables, side tables, side desks, or tables for children.

Figure 4E:
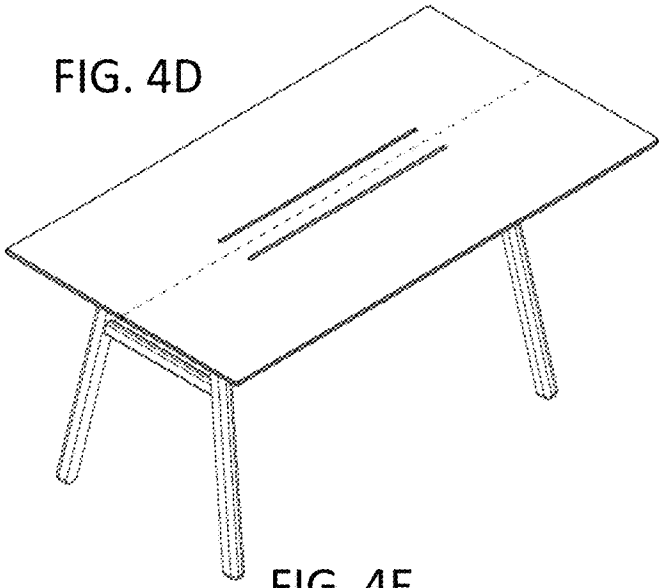

It should be appreciated that the present invention can be made with any number of materials including but not limited to hardwood, veneer, aluminum, steel, stone, Solid Surface, MDF, powder coated MDF, fiberglass, plastic, glass, concrete, or any other similar building material. Further, these materials may be combined in any fashion to arrive at the present invention. However, it is an aspect of the present invention that when a variation uses cooperative material(s), the tabletop may be folded about a centerline for easier shipping, as seen in FIGS. 4E and 4F, and the overall construction of the tabletop, legs, and cable grid is intended to be packed flat and easily assembled.

According to the description of the embodiments above, it will be appreciated that the present invention provides several benefits over existing tables, desks, and other work stations. In particular, the present invention provides a work table that securely holds accessories within a groove. The groove runs between the side ends of the tabletop and is preferably disposed on both sides of the table's lateral axis. Because of the multiple holes within the aperture there are multiple variations of locations for multiple devices within the groove, thus having no presupposed configuration for where tech products or accessories should be supported within the groove. Further, the series of apertures within the groove allow for easy cable pass through at any point therein in addition to the ability to support multiple accessories like lights or shelves. Lastly, cable grid allows a user to removably attach tech product chargers, power strips, or other accessories directly below the work top for easy access.

Figure 5B:
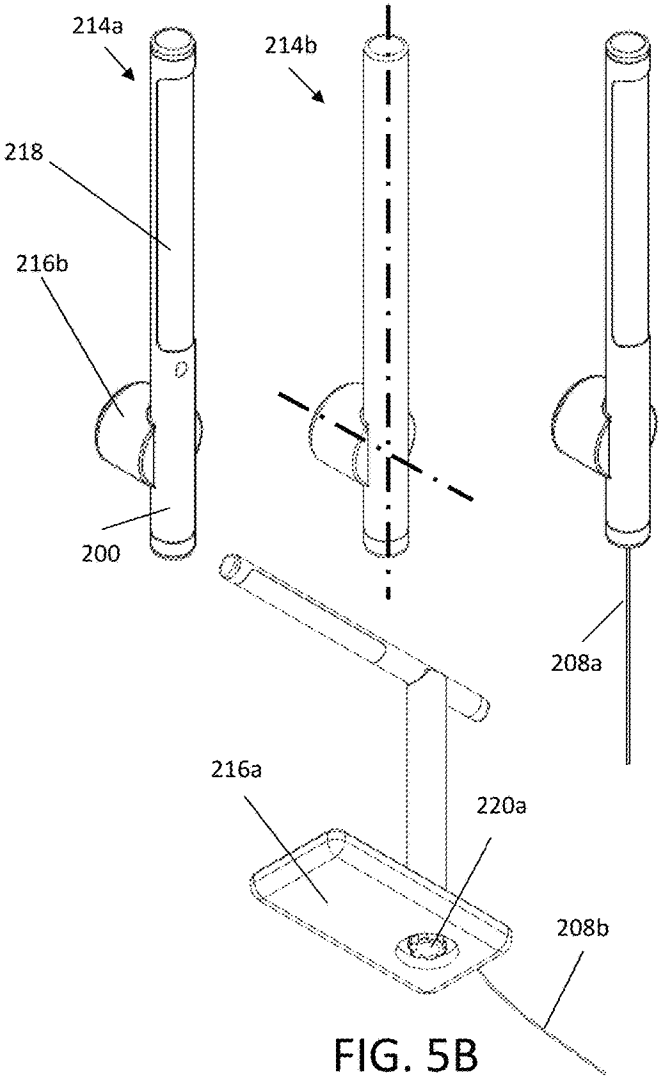
FIGS. 5A-5G are perspective views of a tubular light that can be used with the tabletop of the present invention.
Figure 5A:
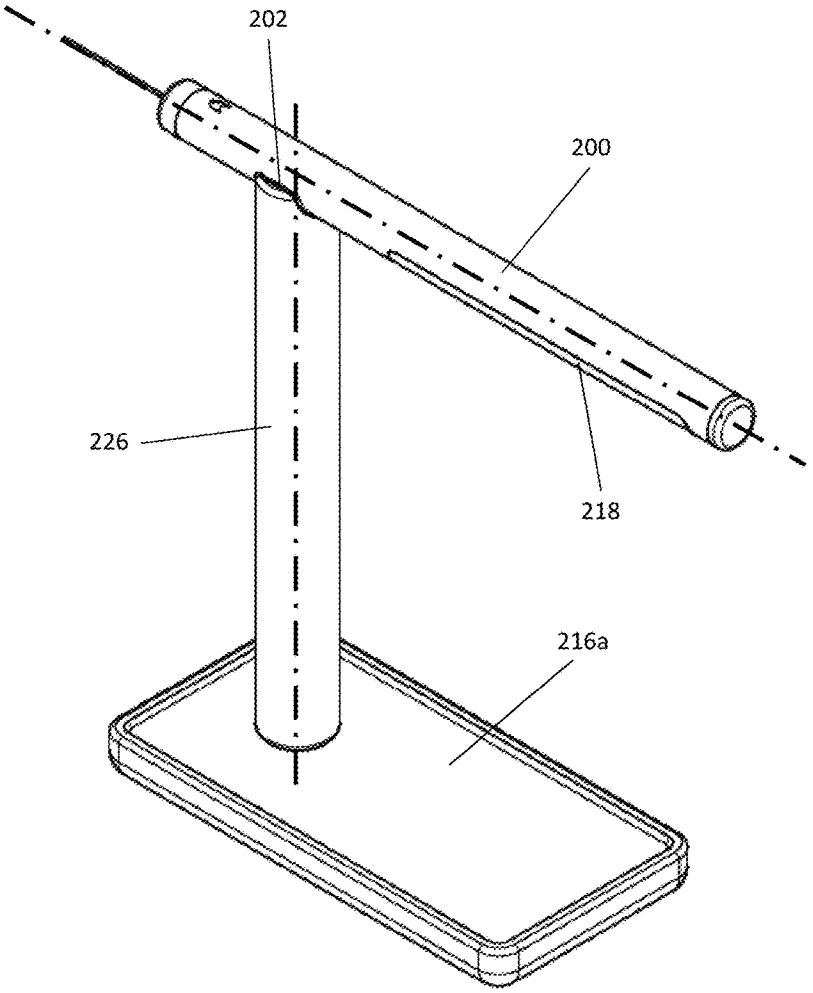
Figure 5E:
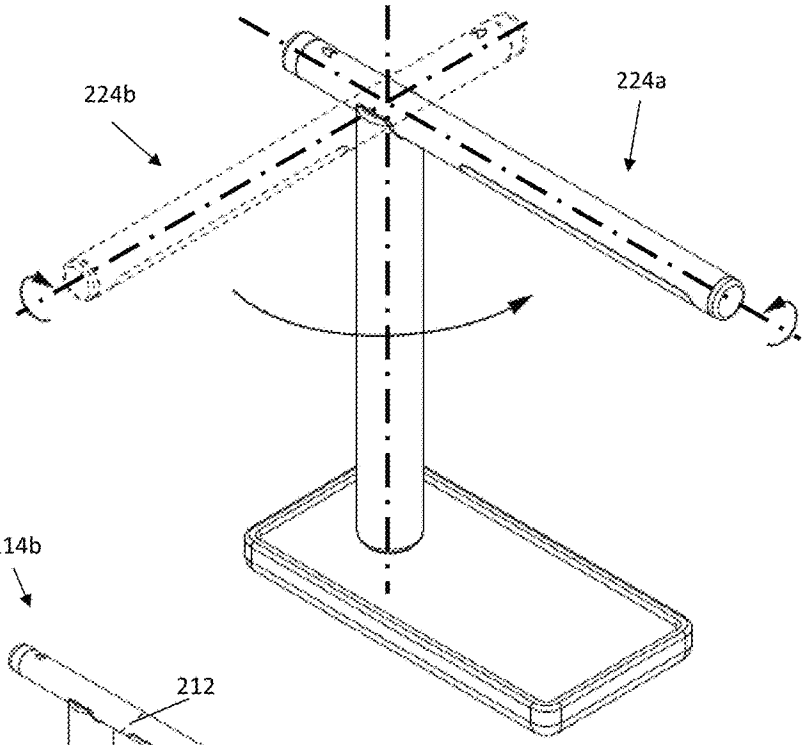
Figure 5D:
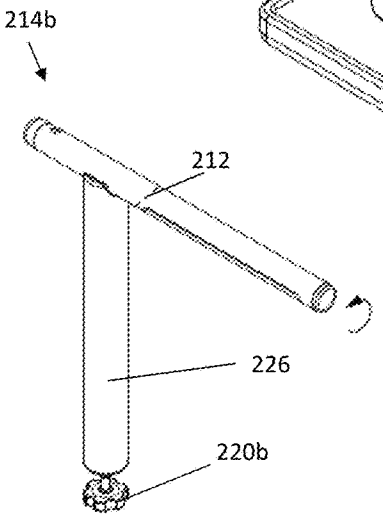
Figure 5C:
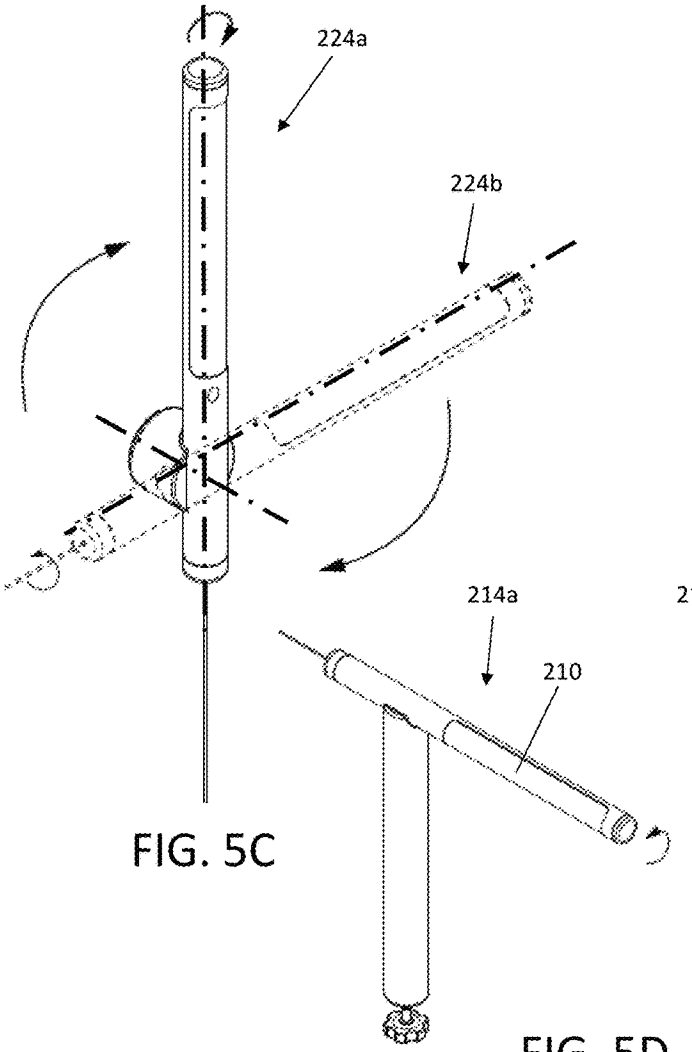
Figure 5F:
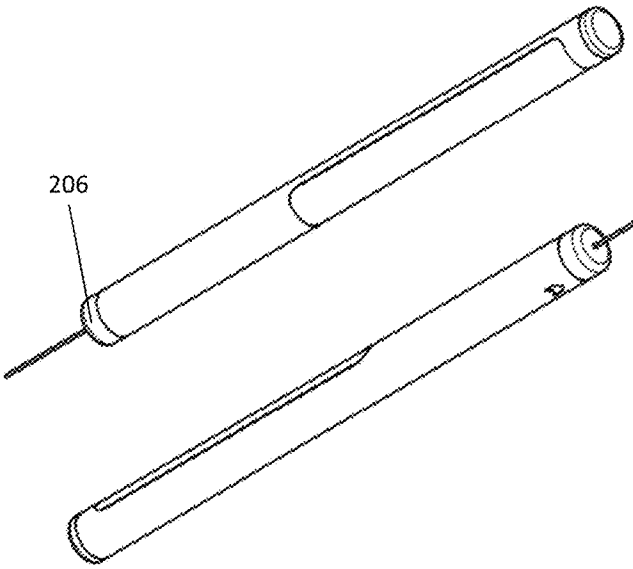
Figure 5G:
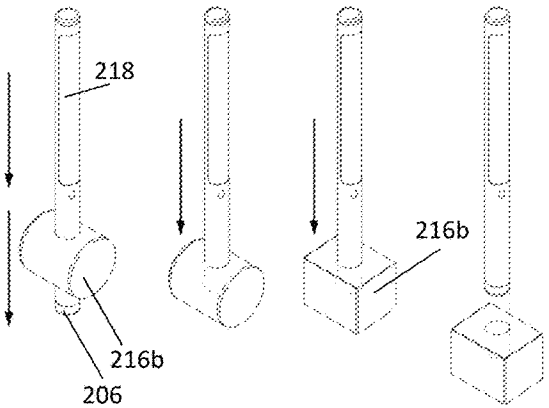
Figure 5H:
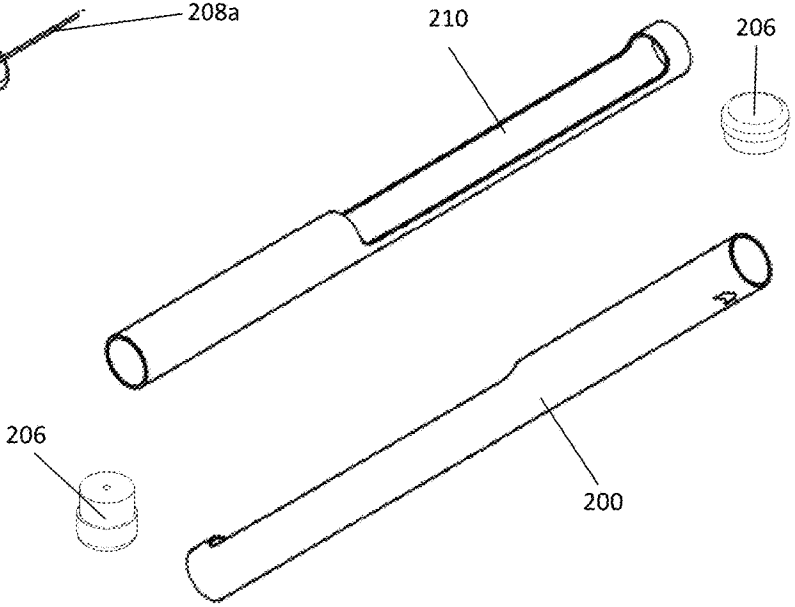
FIGS. 5H and 5I show the components for the tubular light shown in FIG. 5A.
Figure 5I:
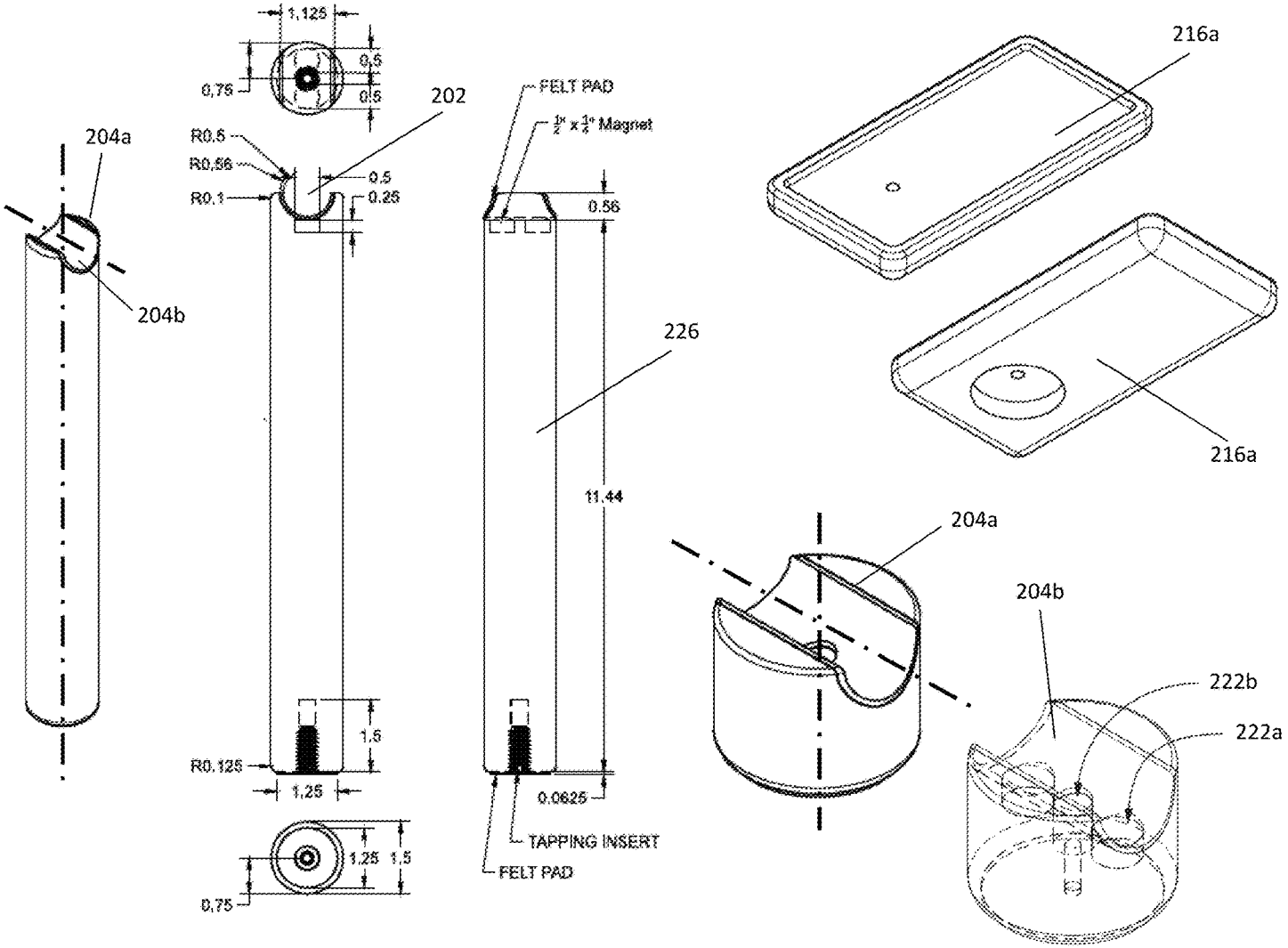

In another aspect of the present invention, the light 100*a* that may be anchored through the aperture has a tubular body 200 that is rotatably held by a mount 202 that has a concave enclosure 204*a* with a conformal wall shape 204*b* to the concave tubular body. The body preferably has a lamp proximate to one end and a plug 206 at the other end which allows access to the interior of the tube and through which a wire can pass if a wire is used. Additionally, the mount or light body may attached to a stand 226, with or without a base 216, or directly connected to the base by a fastener 220*a*. Additionally, the stand may be directly secured within the groove discussed herein by the fastener 220*b* that connects to the stand on the opposite side of the mount. As shown in FIG. 5, the light may be powered through direct connection to a power source by a wire 208*a*, internal battery, or may charge through the connection to the base 208*b*, such as shown in FIG. 5B. The tube body is preferably one seamless piece with light 218 in a specific area of the body 210 or a lamp throughout the entire tube. Where the light is powered by an internal battery, it may receive a charge through a conductive base. In one embodiment of the light, a tubular light is magnetically attached to the mount on a stand and can be rotated to face up, down or sideways, as depicted in FIG. 5.

It will be appreciated that the shape of the lamp's body can be cylindrical, prismatic, or any other shape that may be a matter of design choice. Accordingly, the lamp's body can have a cross-sectional shape 212 that is circular, square, triangular, or any other geometric shape. Preferably, the lamp's body preferably has a cross-sectional shape that is a circle or a regular polygon, being equiangular and equilateral, which allows the lamp's body to be rotated relative to the central axis of the mount's conformal walls. For a cylindrical light tube, the light can rotate while it is positioned within the mount's circular enclosure into varying positions 214*a* and 214*b*. For light tubes with a polygon shape, the tube is first separated from the mount's conformal walls and then rotated before being reset into the mount's enclosure at the different angle.

Although in the preferred embodiment the mating between the tube light and conformal mount is magnetic 222*a*, they may also be attached through other means including by not limited to hooks, friction, interlocking or plastic attachment as well as fasteners such as screws that extend through an aperture in mount 222*b*. It will be appreciated that although the mount is shown as having conformal walls that form a partial enclosure around the tubular body, the conformal walls could form a complete conformal tube shape, creating an aperture within which the light's tubular body is fully enclosed, and in such a design, the tubular body is inserted and removed from the conformal mount by sliding the light tube through the openings on either side of the aperture.

The light with a base stand 216*a* or a small mounting bracket section 216*b* may be affixed to a wall, as shown in FIG. 5. The stand and wall mount can be mounted horizontally or vertically and may include a notched rotation or ball bearings allowing tubular light to move into a variety of positions 224*a* and 224*b*, such as shown in FIGS. 5C and 5E. In another embodiment depicted in FIG. 5, the tubular light is mated with the conformal mount that is attached to a standard lamp stand designed to rest on a desk, table, counter, or similar surface. This embodiment may also be used in combination with the aforementioned desk and anchoring system. In still another embodiment, the light may be used absent from the stand and simply rest within the groove as depicted in FIG. 1E. Regardless of the embodiment selected, the tubular light can remain cordless and be removed from the multiple stand embodiments.

The light has the ability to attach to a stand, with or without a base. The attachment may include magnets or clipping devices and the light member may or may not be corded. The stand is removable from the base for seamless attachment to the desktop using the groove and aperture as described above and shown in FIG. 5D. The light can also be attached to a wall mount. The stand can remain attached to the base for use on most horizontal surfaces. The stand design can also be used for holding other devices, such as headphones. The light tube could be one seamless piece with the light in a specific area or throughout the entire tube.

Preferably, the light has a lithium battery and is powered and charged using near field inductive charging rather than being coupled with direct contact points as found in most standard lighting devices. For the corded version of the light, the power cord is fixed to the light, preferably at the end opposite from the light, rather than being threaded through the base or stand as found in most standard lighting devices. This connection of the cord directly to the light tube allows for the light to be alternatively mounted to the desk stand, to another stand apart from the desk, and to a wall mount. The light member nests on a magnetic or clipping surface within the stand or wall mount, and the light's battery charges when it in its mount. It will be appreciated that the light tube could have an internal battery and may also have a USB or other power cord that removably attached to the light tube.

The light design is different from a standard torch or flashlight because the light emits from the long portion of the shaft rather than the end. Accordingly, in the preferred embodiment, the light design is more like a lantern which allows for many functions, such as a reading light, desk light, walkway light, hall light or mobile lantern. The light rotates about its center axis while nested in the stand, wall mount, desk channel or as a standalone piece. When mounted in the stand, the light tube can rotate about the light shaft axis within the stand, and the stand can rotate about the base. When light tube is connected to the wall mount, the light tube can be rotated to face outward, face the wall, or rest on its side. An integrated power and dimming switch can be included in the light shaft. The light shaft can have a touch sensitive button located on the lens, tube under the lens, or integrated on the end of the light tube or as a switch on the cord.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A table for securely holding accessories and for working, comprised of:

a tabletop comprised of a top surface, a bottom surface, a front end, a back end, and a pair of side ends, wherein the tabletop has a thickness between the top surface and the bottom surface, wherein the tabletop has a width between the pair of side ends, wherein the tabletop has a depth between the front end and the back end, and wherein the tabletop is further comprised of a central lateral axis extending from the front end to the back end equidistant between the pair of side ends;

a plurality of legs connected to and supporting the tabletop;

a groove in the top surface extending for a length between a first end and a second end, wherein the groove is spaced inwardly from the front end, the back end, and the pair of side ends, wherein the groove comprises a bottom trough between a pair of sidewalls, wherein the sidewalls are spaced from each other by a groove width, wherein the bottom trough is positioned below the top surface by a recessed depth, and wherein the recessed depth is no greater than the thickness of the tabletop; and a plurality of apertures within the groove, wherein each one of the apertures comprise a lateral aperture width and a longitudinal aperture length, wherein the lateral aperture width is approximately equal to the groove width at the bottom trough, wherein the longitudinal aperture length is greater than the lateral aperture width and the groove width, wherein each one of the apertures extends from the bottom trough through to the bottom surface of the tabletop, wherein a first set of the apertures are proximate to the first end in the groove and have a first spacing, wherein a second set of the apertures in the groove are spaced a distance apart from the first set of apertures and are proximate to the second end, and wherein the bottom trough connects the pair of sidewalls along the length of the groove at the bottom surface of the tabletop between each one of the apertures.

2. The table of claim 1 further comprising an additional groove in the top surface, wherein the additional groove is spaced apart from the groove with the first and second sets of apertures and is comprised of a third set of apertures.

3. The table of claim 2, wherein the additional groove with the third set of apertures is spaced on an opposite side of the lateral axis from the groove with the first and second sets of apertures.

4. The table of claim 1, wherein the sidewalls extend the recessed depth from the top surface for a part of the thickness of the tabletop towards the bottom surface to the bottom trough, wherein the bottom trough is integrally formed in the tabletop between the recessed depth and the bottom surface, wherein the first spacing of the apertures is approximately equal to the longitudinal aperture length.

5. The table of claim 1, wherein the groove is comprised of a slot in the tabletop and a slot bracket mounted to the tabletop, wherein the slot bracket forms the bottom trough of the groove and connects the pair of sidewalls, wherein the slot extends the thickness of the tabletop from the top surface to the bottom surface, and wherein the apertures are formed in the slot bracket.

6. The table of claim 1, wherein the distance between the second set of apertures and the first set of apertures is the same as the first spacing between the apertures in the first set of apertures, wherein the apertures provide a plurality of accessory mounting positions within the groove, and wherein the accessory mounting positions have a plurality of optional arrangements within the groove.

7. The table of claim 1, further comprising a cable grid and a fastener, wherein the cable grid is comprised of a front face, a back face, and an array of apertures, wherein the fastener extends through the array of apertures and removably secures a section of at least one of the accessories to at least one of the front face and the back face, and wherein the cable grid is attached to at least one pair of the plurality of legs beneath the bottom surface of the tabletop.

8. The table of claim 1, wherein the length of the groove is greater than the depth of the tabletop, wherein the back end of the tabletop is further comprised of an elongated notch having a cut-in distance similar to the groove width and a span on the same order of magnitude as the length of the groove.

9. The table of claim 1 further comprised of a mounting bracket and a fastener, wherein the mounting bracket is inserted through at least one of the apertures and is secured below the tabletop with the fastener.

10. The table of claim 9, wherein the table is further comprised of at least one of a desk, conference table, a side table, an end table, and a night stand, wherein one of the accessories is removably affixed to the tabletop by the mounting bracket and the fastener, and wherein the accessories are at least one of the accessories comprising a light, a shelf, a monitor mount, a cable stop, a pencil tray, and a writing board.

11. A table for securely holding accessories and for working, comprised of:

a tabletop comprised of a top surface, a bottom surface, a front end, a back end, and a pair of side ends, wherein the tabletop has a thickness between the top surface and the bottom surface, wherein the tabletop has a width between the pair of side ends, wherein the tabletop has a depth between the front end and the back end, and wherein the tabletop is further comprised of a central lateral axis extending from the front end to the back end equidistant between the pair of side ends;

a plurality of legs connected to and supporting the tabletop;

a first groove in the top surface extending for a first length between a first end and a second end, wherein the first groove is spaced inwardly from the front end, the back end, and the pair of side ends, wherein the first groove has a first bottom trough between a pair of first groove sidewalls, wherein the first groove sidewalls are spaced from each other by a first groove width, wherein the first groove bottom trough is positioned below the top surface by a first recessed depth, and wherein the first recessed depth is less than the thickness of the tabletop; and a first set of apertures within the first groove, wherein the first set of apertures extend from the bottom trough through to the bottom surface of the tabletop, wherein a first aperture is proximate to the first end, wherein a second aperture is spaced apart from the first aperture and is proximate to the second end, wherein a plurality of apertures are spaced between the first aperture and the second aperture, wherein each one of the apertures in the first set of apertures comprise a first lateral aperture width and a first longitudinal aperture length, and wherein the first lateral aperture width is approximately equal to the first groove width at the bottom trough wherein the first longitudinal aperture length is greater than the first lateral aperture width and the first groove width.

12. The table of claim 11 further comprising a second groove in the top surface extending for a second length between a second pair of ends and a second set of apertures within the second groove, wherein the second groove is spaced apart from the first groove and is spaced inwardly from the front end, the back end, the pair of side ends, wherein the second groove comprises a second bottom trough between a pair of second groove sidewalls, wherein the second groove sidewalls are spaced from each other by a second groove width, wherein the second bottom trough is positioned below the top surface by a second recessed depth, wherein the second recessed depth is less than the thickness of the tabletop, wherein the second set of apertures is comprised of a pair of apertures respectively proximate to the second pair of ends and at least one aperture between the pair of apertures, wherein each one of the apertures in the second set of apertures comprise a second lateral aperture width and a second longitudinal aperture length, wherein the second lateral aperture width is approximately equal to the second groove width at the second bottom trough, and wherein the second longitudinal aperture length is greater than the second lateral aperture width and the second groove width.

13. The table of claim 12, wherein the second groove is spaced on an opposite side of the lateral axis from the first groove.

14. The table of claim 12, wherein the first length of the first groove is greater than the depth of the tabletop.

15. The table of claim 12, wherein the first groove and the second groove are integrally formed with the tabletop, wherein the sidewalls of the first groove and the second groove respectively extend the first recessed depth and the second recessed depth from the top surface towards the bottom surface to the first bottom trough and the second bottom trough, wherein each one of the apertures in the first set of apertures and the second set of apertures further comprise a first spacing to an adjacent one of the apertures, wherein the first spacing between adjacent apertures in the first set of apertures is approximately equal to the first longitudinal aperture length, wherein the first spacing between adjacent apertures in the second set of a apertures is approximately equal to the second longitudinal aperture length.

16. The table of claim 12, wherein the first groove is comprised of a slot in the tabletop and a slot bracket mounted to the tabletop, wherein the slot extends the thickness of the tabletop from the top surface to the bottom surface, and wherein the first set of apertures are formed in the slot bracket.

17. The table of claim 11, wherein the first bottom trough connects the pair of first groove sidewalls along the length of the firt groove at the bottom surface of the tabletop between each one of the apertures.

18. A table for securely holding accessories and for working, comprised of:

a tabletop comprised of a top surface, a bottom surface, a front end, a back end, and a pair of side ends, wherein the tabletop has a thickness between the top surface and the bottom surface, wherein the tabletop has a width between the pair of side ends, wherein the tabletop has a depth between the front end and the back end, wherein the tabletop is further comprised of a central lateral axis extending from the front end to the back end equidistant between the pair of side ends;

a plurality of legs connected to and supporting the tabletop;

a groove in the top surface extending for a length between a first end and a second end, wherein the groove is spaced inwardly from the front end, the back end, and the pair of side ends, wherein the groove comprises a bottom trough positioned between a pair of sidewalls and located below the top surface by a recessed depth, wherein the sidewalls are spaced from each other by a groove width, wherein the first end and the second end are on opposite sides of the lateral axis, and wherein the length of the groove is greater than the depth of the tabletop; and a plurality of apertures within the groove, wherein each one of the apertures comprise a longitudinal aperture length and a lateral aperture width, wherein the lateral aperture width is approximately equal to the groove width at the bottom trough, wherein the longitudinal aperture length is greater than the lateral aperture width and the groove width, wherein the apertures extend from the bottom trough through to the bottom surface below the groove, wherein a first set of apertures proximate to the first end have a first spacing, and wherein a second set of apertures are spaced apart from the first set of apertures and are proximate to the second end.

19. The table of claim 18, wherein the back end of the tabletop is further comprised of an elongated notch having a cut-in distance similar to the groove width and a span on the same order of magnitude as the length of the groove.

20. The table of claim 18, wherein the bottom trough connects the pair of sidewalls along the length of the groove at the bottom surface of the tabletop between each one of the apertures.

* * * * *